US005979144A

United States Patent [19]

Bailey et al.

[11] Patent Number: 5,979,144

[45] Date of Patent: Nov. 9, 1999

[54] PACKETS AND THEIR MANUFACTURE

[75] Inventors: Thomas William Bailey; Michael John Cahill; James Goodwin, all of Coventry, United Kingdom

[73] Assignee: Lipton, Englewood Cliffs, N.J.

[21] Appl. No.: 08/887,999

[22] Filed: Jul. 3, 1997

[30] Foreign Application Priority Data

Jul. 11, 1996 [EP] European Pat. Off. ..... 96305110

[51] Int. Cl.[6] ..... B65B 29/04

[52] U.S. Cl. ..... 53/413; 53/13.24; 53/450

[58] Field of Search ..... 53/413, 134.2, 53/450, 550, 553; 206/0.5; 426/83, 435

[56] References Cited

U.S. PATENT DOCUMENTS

| | | |
|---|---|---|
| 1,723,702 | 8/1929 | Mitchell . |
| 1,775,347 | 9/1930 | Hirschhorn . |
| 2,149,713 | 3/1939 | Webber . |
| 2,308,241 | 1/1943 | Hogaboom . |
| 2,335,159 | 11/1943 | Salfisberg . |
| 2,359,271 | 9/1944 | Sidebotham . |
| 2,406,018 | 8/1946 | Irmscher . |
| 2,466,281 | 4/1949 | Shaw . |
| 2,468,464 | 4/1949 | Salfisberg . |
| 2,556,383 | 6/1951 | Williams . |
| 2,606,836 | 8/1952 | McCabe . |
| 2,791,505 | 5/1957 | Barnett . |
| 2,819,167 | 1/1958 | Irmscher . |
| 2,852,389 | 9/1958 | Johnson . |
| 2,860,989 | 11/1958 | Geisinger . |
| 2,861,403 | 11/1958 | Weisman . |
| 2,878,927 | 3/1959 | Winchester . |

(List continued on next page.)

FOREIGN PATENT DOCUMENTS

| | | |
|---|---|---|
| 118215 | 3/1944 | Australia . |
| 14035/88 | 10/1989 | Australia . |
| 448 325 | 9/1991 | European Pat. Off. . |
| 489 554 | 6/1992 | European Pat. Off. . |
| 1169388 | 9/1958 | France . |
| 870 516 | 3/1953 | Germany . |
| 1 022 960 | 1/1958 | Germany . |
| 1 654 971 | 8/1967 | Germany . |
| 1 281 927 | 10/1968 | Germany . |
| 87 0 075 | 10/1987 | Germany . |
| 3807 763 | 9/1988 | Germany . |
| 3826911 | 2/1990 | Germany . |
| 570 798 | 12/1975 | Switzerland . |
| 809573 | 2/1959 | United Kingdom . |
| 962038 | 6/1964 | United Kingdom . |
| 1 541 054 | 2/1979 | United Kingdom . |
| 2 052 428 | 1/1981 | United Kingdom . |
| 2 094 267 | 9/1982 | United Kingdom . |
| 2 049 547 | 2/1983 | United Kingdom . |
| 2 151 214 | 1/1987 | United Kingdom . |
| 2 201 934 | 9/1988 | United Kingdom . |
| 2 202 819 | 10/1988 | United Kingdom . |
| 2 231 023 | 11/1990 | United Kingdom . |
| 91/13580 | 9/1991 | WIPO . |
| 92/06903 | 4/1992 | WIPO . |
| 93/19997 | 10/1993 | WIPO . |
| 94/22721 | 10/1994 | WIPO . |
| WO 95/27666 | 10/1995 | WIPO . |
| WO 97/19005 | 5/1997 | WIPO . |

*Primary Examiner*—Daniel B. Moon
*Attorney, Agent, or Firm*—James J. Farrell

[57] ABSTRACT

A process and apparatus are described for producing drawstring packets. The packets are produced by forming thread loops (L) with tags (T) attached to their ends and placing the packet web material (W) onto the portions of a the loops further from the tags. After securing the loops in their shaped form temporarily to one face of the web, the tags and the remaining portions of thread are placed on the other face of the web to be attached there releasably. In subsequent processing the secured loop portions lie inside the packets and the tags outside. The process allows relatively precise location of the loops so that packets can be produced with the loops in a peripheral channel (P) sealed from the contents of the packets but able to move to contract the package when the ends of the loop are pulled.

12 Claims, 6 Drawing Sheets

U.S. PATENT DOCUMENTS

| | | | |
|---|---|---|---|
| 2,881,910 | 4/1959 | Murphy . | |
| 2,925,171 | 2/1960 | Eaton . | |
| 2,929,257 | 6/1960 | Bartelt . | |
| 2,986,269 | 5/1961 | Goldberg . | |
| 3,092,242 | 6/1963 | Irmscher . | |
| 3,143,834 | 8/1964 | Irmscher . | |
| 3,191,355 | 6/1965 | Morpurgo . | |
| 3,223,229 | 12/1965 | Welin-Berger . | |
| 3,237,550 | 3/1966 | Christopher . | |
| 3,283,672 | 11/1966 | Mueller . | |
| 3,316,686 | 5/1967 | Welin-Berger . | |
| 3,396,032 | 8/1968 | McCrae et al. . | |
| 3,539,355 | 11/1970 | Kasakoff . | |
| 4,055,668 | 10/1977 | Kopp | 206/0.5 X |
| 4,288,224 | 9/1981 | Romagnoli . | |
| 4,415,597 | 11/1983 | Romagnoli . | |
| 4,506,490 | 3/1985 | Klar . | |
| 4,680,185 | 7/1987 | Illk . | |
| 4,735,810 | 4/1988 | Dacal . | |
| 4,828,851 | 5/1989 | Romagnoli . | |
| 4,829,742 | 5/1989 | Romagnoli . | |
| 4,856,257 | 8/1989 | Romagnoli . | |
| 4,961,301 | 10/1990 | Bonomelli | 53/134.2 X |
| 4,977,728 | 12/1990 | Rambold . | |
| 5,135,762 | 8/1992 | Vernon et al. | 53/134.2 X |
| 5,358,724 | 10/1994 | Raffaele | 426/83 X |
| 5,366,741 | 11/1994 | Van Der Zon | 206/0.5 X |
| 5,399,224 | 3/1995 | Vernon et al. | 53/134.2 X |
| 5,511,359 | 4/1996 | Kenney | 53/134.2 X |
| 5,527,419 | 6/1996 | Vernon et al. | 53/134.2 X |
| 5,552,164 | 9/1996 | Kuipers et al. | 53/134.2 X |
| 5,552,165 | 9/1996 | Haak et al. | 53/134.2 X |
| 5,632,132 | 5/1997 | Kuipers et al. | 53/134.2 X |
| 5,674,544 | 10/1997 | Shakspeare | 426/83 X |

PACKETS AND THEIR MANUFACTURE

This invention relates to a method and apparatus for producing packets containing a flowable material, in particular but not necessarily exclusively an infusible material such as tea or coffee, the packets being equipped with means for applying pressure to express liquid from them after infusion. The invention also relates to packets having such means.

DESCRIPTION OF THE RELATED ART

Numerous proposals exist for infusion packets in the form of tea bags having means for expressing liquid from them, in particular having tagged drawstrings or threads attached that can be pulled to contract the bag.

The efficiency of such arrangements can be critically dependent upon the placing of the thread relative to the bag envelope material. Generaly speaking it is desirable to run the thread to one or more extremities of the bag and to retain it there while the bag is being contracted, but this must be done in such a way that it does not compromise the integrity of the sealing that retains the infusion material in the packet. A significant factor in this is that the forces applied to express the liquid require a tension in the thread that can put considerable local stresses on the bag envelope material. Nor should the thread stray to any place where it would interfere with the infusion process.

BRIEF SUMMARY OF THE INVENTION

According to one aspect of the present invention a method is provided of producing packets containing a flowable material and each provided with a thread for contracting the packet, comprising the steps of forming thread loops and attaching the ends of the loops to successive tags, placing one face of a web of the packet envelope material against intermediate portions of the thread loops while maintaining the web spaced from the tags and releasably attaching the web to the portions of the thread loops placed against it, bringing the tags with the remaining portions of the thread loops over the opposite face of the web and attaching them thereto, doubling over the web to form a flattened tube with the intermediate portions of said loops located between opposed walls thereof and with said tags and remaining end portions of said loops on the exterior of the tubular form web.

In a modified form of said method, instead of doubling over a web of packet envelope material, two separate webs are used and said webs are joined together to hold the intermediate portions of the thread loops between them. Said thread loops are attached, as aforesaid, to one web and are then overlaid by the other web.

In either case, the method is able to be operated in a continuous manner to place the thread loops in position on respective walls that are to lie on the interior and exterior of the envelope while ensuring that the thread placed on the interior wall in particular is located with a required degree of precision because it is attached to the envelope wall material when the web and thread are first brought together. Although the attachment may be only temporary, it can ensure that the location of the thread is not disturbed during the subsequent stages of the formation of the package.

In a further aspect of the invention, apparatus for producing packets with tag means attached to a thread for contracting the packet comprises transport means on which the tags and thread are brought together, means for forming loops in the thread and for attaching the ends of the loops to successive tags to form tag-thread assemblies, combining means for bringing the tag-thread assemblies together with a web envelope material, said combining means being arranged to place intermediate portions of the thread loops against one face of the web and attach them releasably thereto with the tags and adjacent portions of the loops overlapping a aide edge of the web, there being means for placing the tags and their associated thread portions over the opposite face of the web and attaching them thereto, means for forming the web into a tubular shape with said intermediate loop portions in the interior thereof and the tags and their associated end portions of the thread loops on the exterior, means for dosing a filling material into said tubular-shape web, and means for heat sealing between opposite faces of the web to contain the filling material and for separating the individual packets therefrom with a thread loop and tag associated with each packet.

Analogously to the method according to the invention, said apparatus may be modified to join together two separate webs with the intermediate portions of the loops between them and the remaining end portions and the tags on the outer face of the packet.

The ability to control the placing of the thread can be employed to reduce the risk of rapture of the packets. Where, as in different known arrangements, the thread passes through holes in the material or through gaps between opposite walls at an edge of the envelope, there is an increased risk that these stresses will tear the envelope and allow its contents to escape. This danger can be mitigated by keeping the bag interior separate from the thread, as in proposed in U.S. Pat. No. 3,415,656, but it is difficult to wake the infusion packets described there in an economical manner.

The method of the present invention may then further comprise the steps of sealing opposite walls of the envelope material, whether as a tubular web or two superimposed webs, to form a series of inner spaces along its length containing the infusible material, said intermediate portions of the loops lying in further spaces between said opposite walls and surrounding or partly surrounding said inner spaces but sealed from them, said further spaces extending to locations on a side edge of the web from which the further thread portions extend over the exterior of the web or webs.

Apparatus according to the invention may analogously be further provided with means for sealing together opposite walls of the web material, whether as a tubular web or two superimposed webs, to form discrete spaces containing the infusion material and said further spaces containing the intermediate thread portions respectively, and means for separating the individual packets each with a thread loop and associated tag.

According to another aspect of the invention, a preferred form of packet may be produced using a method as set out above, in which the packet envelope encloses an inner space within which the flowable material is held and an outer marginal space sealed from said inner space and containing the intermediate portion of the thread, said intermediate portion extending around a major part of the periphery of the envelope to spaced locations of a first side edge, further lengths of the thread continuing from said intermediate thread portion and projecting from said marginal space at said locations, said lengths of thread being held against an external face of the envelope and being secured to tags means releasably attached to the exterior of the envelope.

By way of illustration, examples of the invention will be described in more detail with reference to the accompanying drawings. In the drawings:

DETAILED DESCRIPTION OF THE INVENTION

Figure 1:
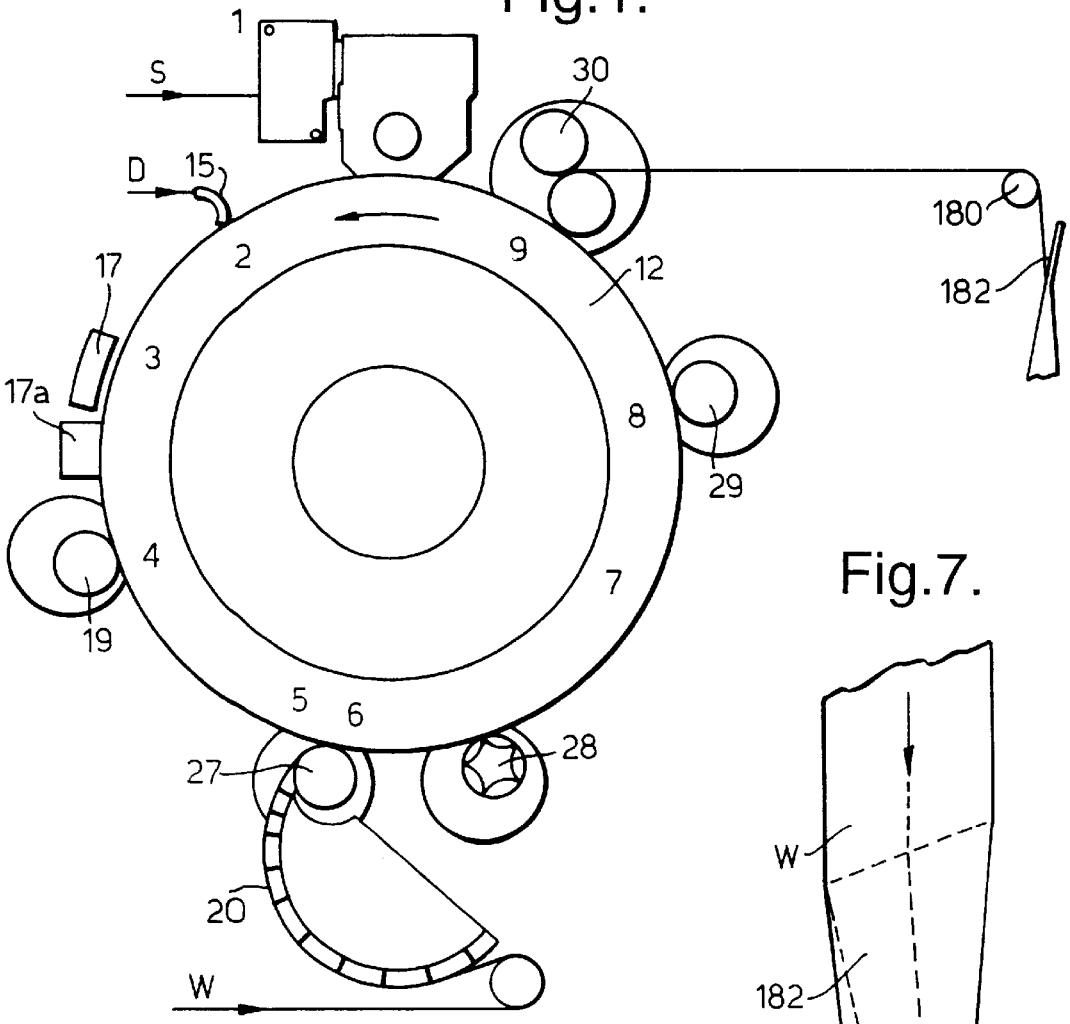
FIG. 1 is an outline illustration of the assembly drum of a packet-making installation in which the invention is incorporated.
Figure 2:
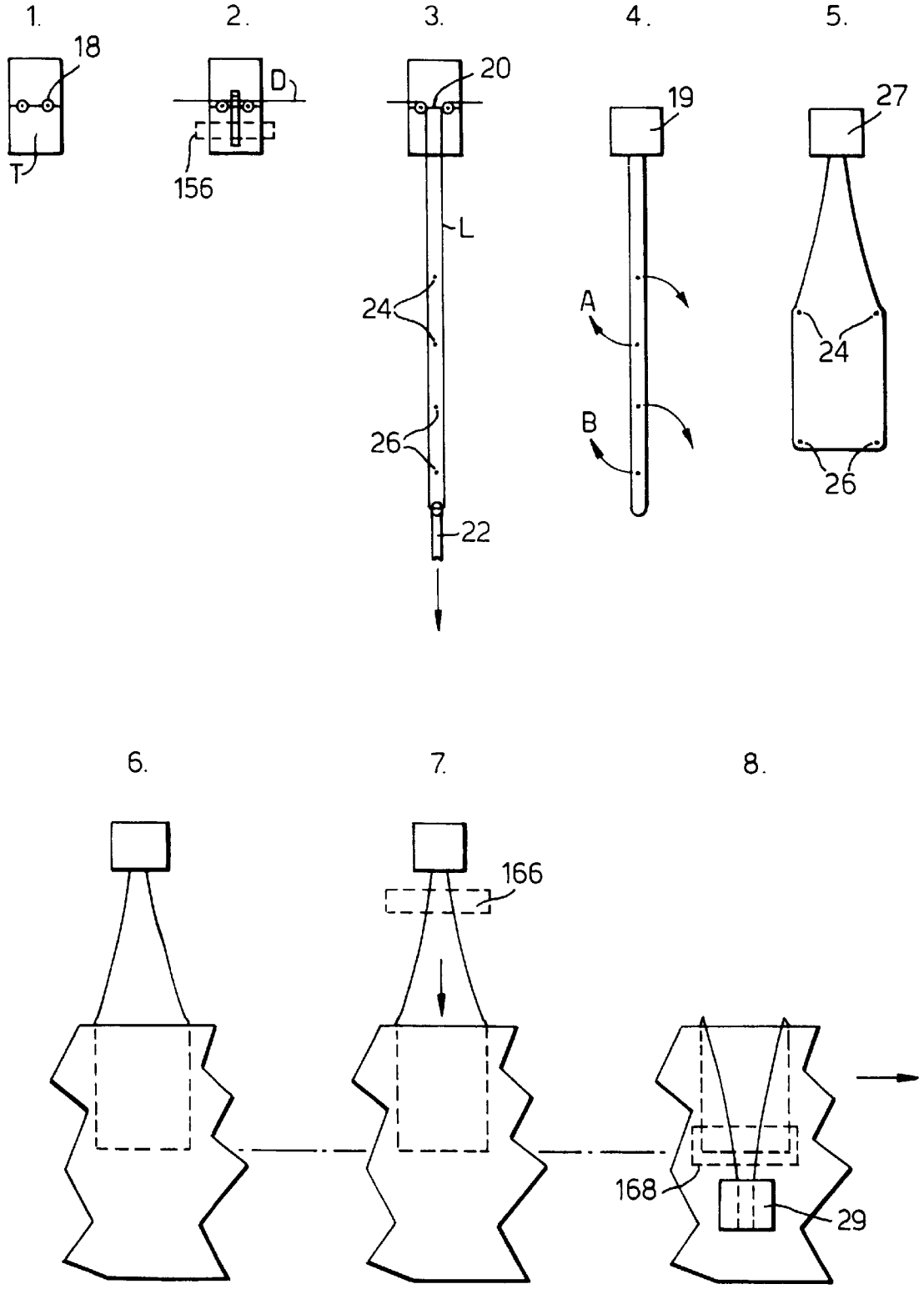
FIG. 2 illustrates the building of the tag-thread-web assembly on the drum at the first 8 numbered stages indicated in FIG. 1.

FIG. 1 shows a drum 12 of the apparatus on which thread D, tags T and heat-sealable web material W for forming half packets are brought together as it rotates anti-clockwise, while FIG. 2 illustrates schematically steps in the assembly of the thread, tags and web on the drum 12 at the first 8 of a series of numbered stages 1–9 indicated in FIG. 1.

The tags T are fed as a continuous strip S to a tag cutting device 13 at stage 1. The individual tags are separated from the strip and deposited at peripherally spaced locations on the drum 12 in a manner not further illustrated here but described in PCT/GB94/02227 (WO95/10462). FIG. 2 shows a tag T separated from the tag strip S as it is first located in its flat unfolded form on a suction seat 14 (FIGS. 3 and 4) on the drum from which a spaced pair of pins 16 project through holes 18 located on a centre fold line 20 of the tag.

As in WO95/10462, thread D drawn from a reel (not shown) is led into the drum by a guide 15 and is laid over the flat tag to one side of the pine 16 (stage 2 in FIG. 2). The thread between the pins is then engaged by a hook 22 and drawn out in an elongate loop L between stages 2 and 3, extending over two further pairs of thread pins 24,26. As the drawing out of the thread, is completed, the tag comes under a pre-heater 17 which softens a heat-sealing coating on its exposed face. A fixed plough 17*a* then folds the tag over about its fold line 20. A pressure roller 19 ensures the folded tag in firmly sealed against the ends of the thread loop at stage 4. The pairs of thread ping 24, 26 are displaced transversely as indicated by the arrows A, B between stages 4 and 5, to shape the loop so that one end has the substantially rectangular form shown at stage 5.

The web material W of the packets is then brought over a fixed preheater 20 and onto the drum at stage 6, overlapping with the thread loops, so that the ends of the loops further from the tags are at or close to the web centerline. As the web is placed onto the thread it is tack welded to it by a heated roller 27. At this point the portions of thread between successive tags are cut off by a rotary cutter 28 and drawn away for disposal, leaving only the loops L attached to respective tags.

Between stages 6 and 7, each tag and the exposed portion of its thread loop are drawn over the web and at stage 8 the tag is lightly tacked to the web by heated roller 29. At stage 9, as the web with tags and thread attached is led off the drum, each tag is tacked more firmly to the web by a further heated roller 30, the tag then being more easily accessible because the mechanism carrying the tag across the web has been retracted from it.

The drum 12 on which these operations are performed and some of its associated mechanisms are illustrated in more detail in FIGS. 3 to 6. The drum in rotatably mounted or. a central fixed arbour 32 through bearings 34. At one end of the rotary drum a ring of seats 14 for tags are mourted in recesses 14*a* spaced around its periphery and suction is applied to the seats through conduits 38, 38*a* leading from each seat to fixed distribution channels 40, 40*a* connectable to a conduit 42 from a suction source (not shown). A fixed plough 44 (FIG. 1) is located over the tag seats to fold the tags in place as the drum 12 rotates past it at the appropriate stage as already described.

Figure 4:
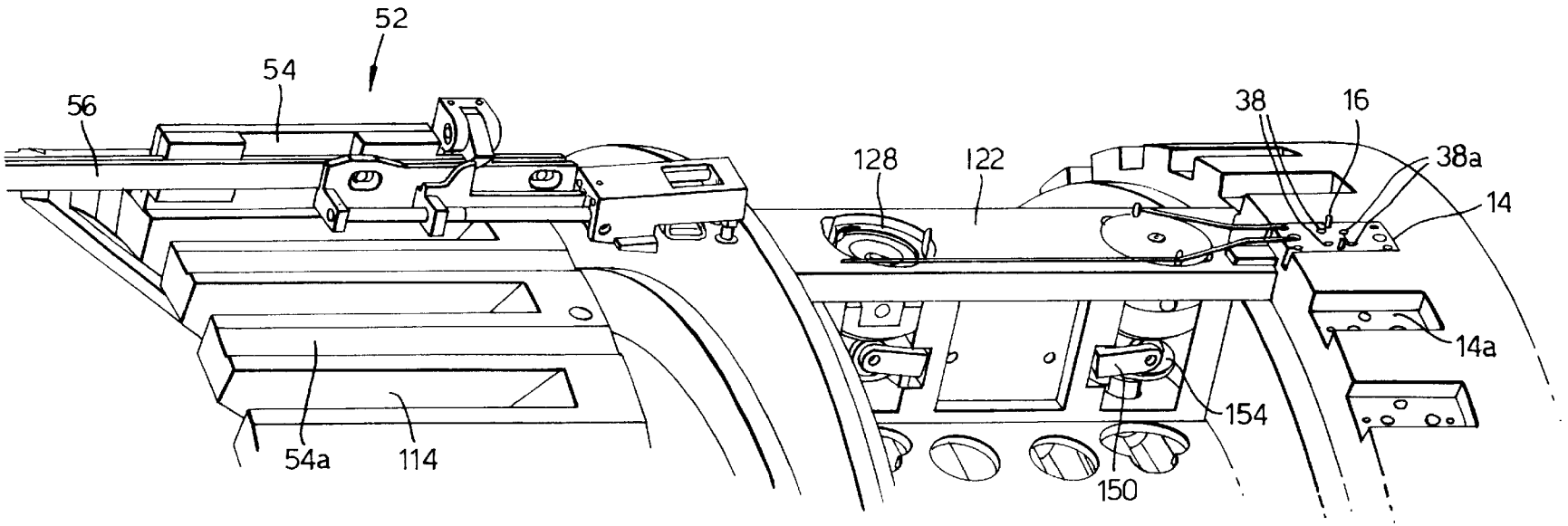
FIG. 4 is a partial oblique view of the drum, with some of the parts omitted for simplicity and clarity.

The hooks 22 associated with the tag seats are carried by respective shuttles 52 mounted on the opposite end of the drum from the tag seats 14, but for greater clarity, FIG. 4 shows only one of the shuttles and its guide 54. As can be seen from FIG. 4, opposite each seat 14 an axially directed guide 54 is fixed to the drum in a keyway 54*a* and slidably mounted in the guide is a rail 56 of a respective hook shuttle 52. A side extension 58 secured to the rail 56 comprises a shaft 60 fixed between opposite end lugs 62, 64. A carrier 66 is slidably mounted on the shaft 60 to be movable parallel to the rail 56. The carrier 66 is also guided by a pin 68 projecting into a slot 70 in the extension 58.

The hook 22 is fixed to a block 72 which is mounted on the forward lug 64 of the carrier by a pivot pin 74. An arm 76 in pivoted on the carrier through a pin 78. The forward end of the arm extends over the block 72 and carries a pair of suction cups 80 disposed to opposite sides of the hook 22.

Figure 5:
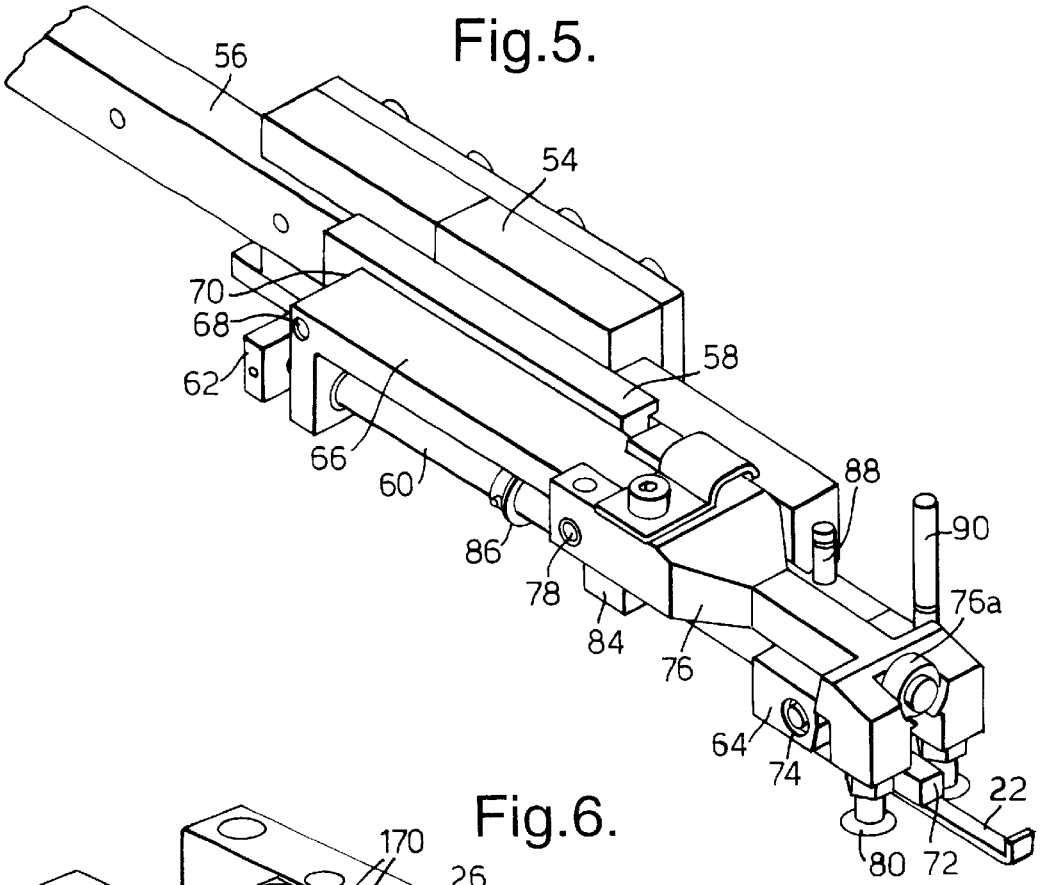
FIG. 5 is an oblique view of a modified form of one of the loop-forming shuttles mounted on the drum.

A compression coil spring (not shown) is mounted on the shaft 60 between a lug 84 of the carrier 66 and a collar 86 fixed to the shaft, so urging the carrier forwards to a position in watch the suction cups 80 project beyond the hook 22. The mechanism is shown in FIG. 5, however, in a state in which the carrier 66 has been moved to a rearwards end position, compressing the spring on the shaft 60, and retracting the suction cups behind the hook.

The arm 76 is shown in its state of rest, pivoted outwards to its maximum extent by a biasing spring (not shown) acting about the pivot 78, so holding the suction cups raised above the hook. The hook is also shown in its normally biased position extending parallel to the drum axis, having been pivoted outwards to its maximum extent by a tension spring (not shown) between posts 88, 90 secured to the forward end of the extension 66 and to the block 72 respectively.

The movement of the shuttles 52 in the guides 54 is controlled by a cam mechanism comprising a closed loop cam groove 102 fixed to the drum arbour 32. A bracket 104 fixed to each shuttle rail 56 has a pivot pin 106 engaging elongate slot 10s in one end of a link 110, the other end 112 of which is held in the groove 102. As the drum rotates, the link end runs along the cam groove 102 which is shaped to pivot the link 110 and reciprocate the shuttle 52 across the drum, to and from its tag seat to draw out the thread loop as indicated at stage 2 in FIG. 2. The slots 114 between the keyways 54*a* accommodate the pivoting of the links 110 in these movements.

Figure 3:
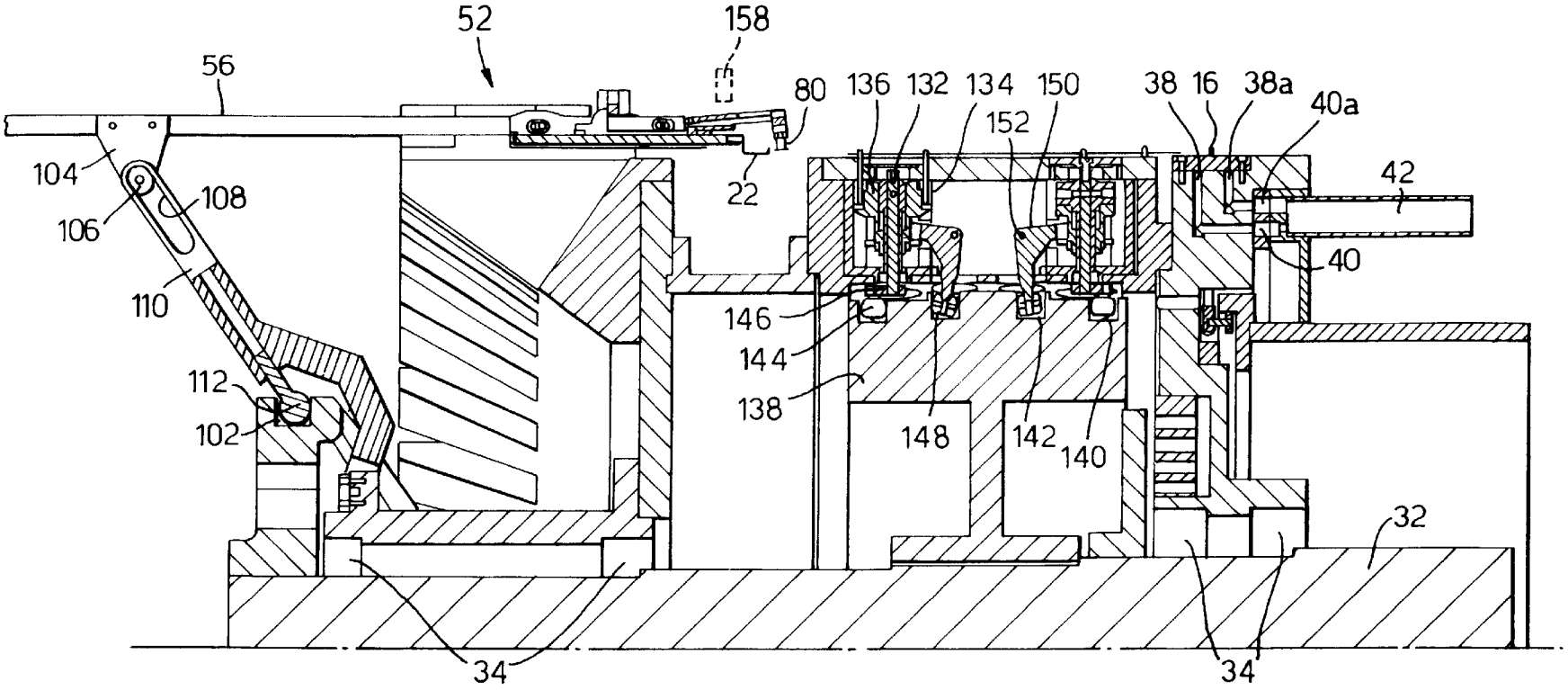
FIG. 3 is a half-section of the drum of the installation on which the tags, thread and packet web are assembled together.
Figure 6:
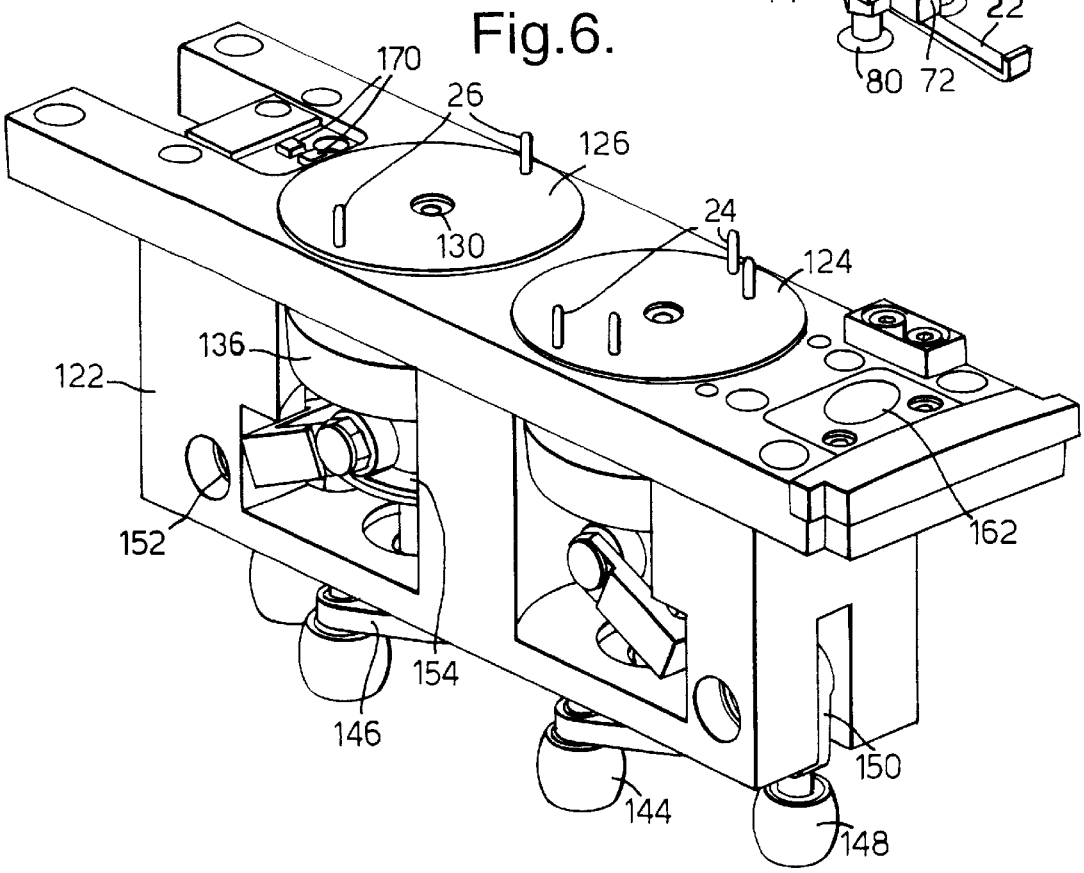
FIG. 6 is an oblique view of one of the loop-shaping mechanism on the drum.

The pairs of pins 24, 26 and their associated operating mechanism are provided between each tag seat 14 and its shuttle 52, although for clarity only one such mechanism is shown in FIGS. 3 and 4 where the respective pairs of pins are drawn in different positions to illustrate better the details of the mechanism. As FIG. 2 makes clear, the pins pivot in unison. FIG. 6 illustrate the pins and their operating mechanism in more detail.

Each mechanism comprises a unit frame 122 secured to the outer peripheral face of the drum. Each pair of pins 24, 26 projects radially through a respective disc 124, 126 mounted in the outer face of the frame 122. Each disc is located against a peripheral shoulder 128 (FIG. 4) of the fratre and is secured by screw 130 to a radially directed shaft 132. Each shaft has its axis radial to the drum and is rotatable about that axis with its disc.

The pins 24, 26 extend slidably held through bores to their discs and are secured to a ring 134 engaged with a sleeve 136 slidably mounted on the shaft. They are spring-loaded to project from the discs but can be depressed against the spring force. They can also move radially with the sleeve 136 between the projecting position shown in particular in FIG. 6, and a position in which they are retracted substantially flush with their discs.

As the drum rotates on the arbour 32 the shafts 132 are rotated and the sleeve 136 is reciprocated by cain mechanisms that comprise profiled tracks extending around an inner cylinder 138 (FIG. 3) fixed to the arbour.

For each of the two discs there are two cam tracks 140, 142. Each track 140 provides it path for a follower 144 attached to a crank arm 146 on the shaft 132. As the follower 144 is displaced axially of the drum the shaft 132 pivots to swing its disc 124 or 126, and so a respective pair of pins 24 or 26, through about 90°, to and from the position in which they are aligned axially of the drum. The other track 142 of each pair is engaged by a follower 149 mounted on a bell crank lever 130 that is supported on a pivot 152 which is fixed to the unit frame 122. The other end of the lever is held in an annular collar 154 attached to the sleeve 136, so that movement of the follower 148 generated by the axial contour of the track 142 slides the sleeve 136 and its pine 24 or 26 radially of the drum.

In the operation of the apparatus, a first function of the hooks 22 is to draw the thread out into a loop over each tag seat 14, as already described. For this action each shuttle 52 is extended by the mechanism comprising the cam groove 102 to place the hook 22 between the pins 14 of its tag seat. Before the shuttle reaches its fully extended position, however, the arm 76 comes against a fixed abutment 156 (FIG. 2) which holds it and the suction cups back as the hook arrives over the tag seat. The arm 76 and suction cups are thus held clear of the tag seat while the thread in placed on the hook as it in laid across the tag seat.

The shuttle 52 is then retracted by its cam mechanism and the thread caught in the hook 22 is drawn in a loop across the drum. After the shaping of the loop by the pairs of pins 24, 26 which will be described in more detail below, the hook reaches the position shown in FIG. 3. it is now depressed by a fixed trip 158 (FIG. 3) adjacent the drum which, strikes the post 90 to pivot the block 72 downwards. The thread loop, which is under tension as will now be described, is then able to slip off the hook.

During the drawing out of the thread, suction from the conduit 42 has also been acting on a vacuum tube 162 (FIG. 6) adjacent the tag seat and over which the thread passes. Any excess length of thread is drawn into the tube by the suction which also tensions the loop lightly. From its fully extended position in stage 3 of FIG. 2, the loop is thus pulled back against the pins 24, 26.

During the return of the shuttle 52 across the drum. drawing out the thread loop, the pins 24, 26 on the discs 124, 126 are still in line as they are still in stage 4 of FIG. 2, and they are also held retracted radially by the sleeve 136 to leave clearance for the passage of the shuttle. As soon as the hook has returned past them the pine are raised, and are rotated under the control of the cam track 142 to form the loop of stage 5 of FIG. 2.

At this point the relevant tag seat reaches stage 6 in the rotational path of the drum at which the packet web W is applied to the drum, over the thread loops but axially spaced from the tags. The pins 24, 26 retract slightly an the heated roller 29 (FIG. 1) applies light tacking welds to locate the thread loop to the web but they continue to control the shape of the loop until this step is completed.

The post 90 runs off its fixed abutment 158 to allow the hook to return to its original position once it has slipped the loop, and the shuttle is now set to be moved forwards again across the drum with the hook clear of the thread loop and web, until the suction cups 80 are brought over the folded tag. A fixed abutment 166 (FIG. 2) adjacent the drum then contacts roller 76*a* to swing the arm 76 downwards about the pivot 78 to bring the cups 80 momentarily against the folded tab as suction is applied to the cups. The suction is maintained an the arm 76 is released by the abutment 166 to swing away from the tag seat so that the suction cups lift the tag from its locating pins 16. The shuttle now returns across the drum, with the tag held by the suction cups and drawing thread from the suction tube 162. The arm 76 is pivoted by a further fixed abutment 168 (FIG. 2) at the end of this movement to deposit the tag on the web, laterally beyond the thread loop. While it is held by the suction cups, the tag is initially lightly tack welded to the web by heated pads 170 (FIG. 6). The web, with the tag and thread loop attached to it has now reached the station at which it leaves the drum.

Figure 7:
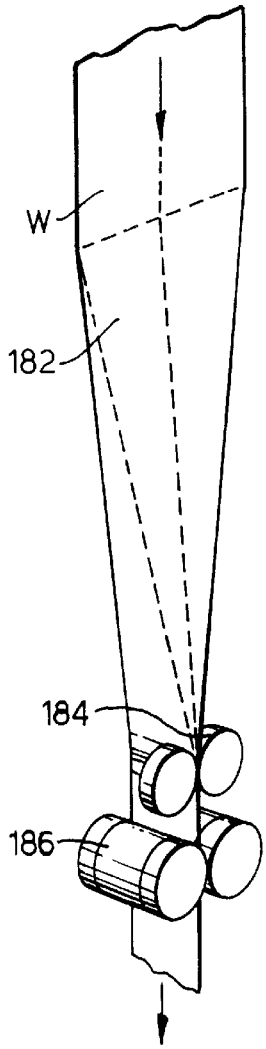
FIG. 7 illustrates the form-fill process performed after the web has left the drum.

The subsequent processing to produce completed infusion bags comprises the bag forming and filling process shown in FIG. 7. The web with tags and thread attached is guided over a roller 180 (FIG. 1) onto the wider end of a substantially triangular former plate 182. It is driven down the plate 182 by a pair of pre-sealing rollers 164 which pinch and tack the opposite edges of the web together, and/or by larger bag-sealing rollers 186 which form seals that define a sealed chamber C in each bag and a U-shaped channel P in the doubled over web and in which the thread loop lies. Immediately above the rollers 186, a dosing nozzle (not shown) projects into the folded over web to deliver doses of the infusion product that are sealed into the chamber C by the rollers 186. Further downstream, a cutter (not shown) separates the individual bags.

Figure 8:
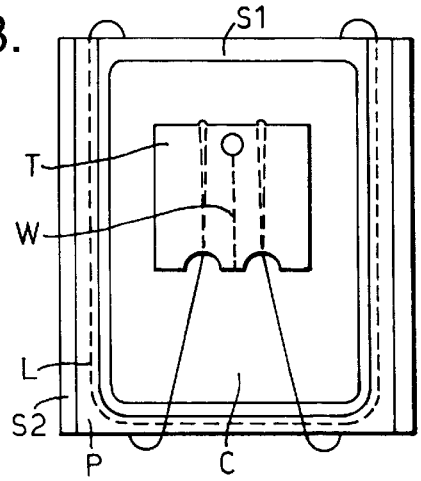
FIG. 8 is a more detailed illustration of a completed single-chamber infusion packet from the process described in the preceding figures.

As is clear from FIG. 8, the seals made by the sealing rollers 186 include generally rectangular loop S1 defining the chamber C and the inner edges of the channel P, and a pair of opposite side seals S2 which complete the formation of the channel P surrounding the chamber which it will be seen is sealed from the chamber.

Dosing of an assembly of web, tags and thread as produced by the apparatus of FIGS. 1 to 6 and the sealing of those doses to form infusion packets can however, be performed in a variety of other ways which are known in principle.

In use, the tag and the thread on the exterior can easily be freed because they are only lightly tack-welded to the web material. The tag can then be split along a line of weakening W, the two parts then being attached each to one end of the thread. If the two ends are pulled apart, because the thread can move freely in the channel P, the tea bag is contracted and liquid left in it from infusion can be so squeezed out.

Figure 9:
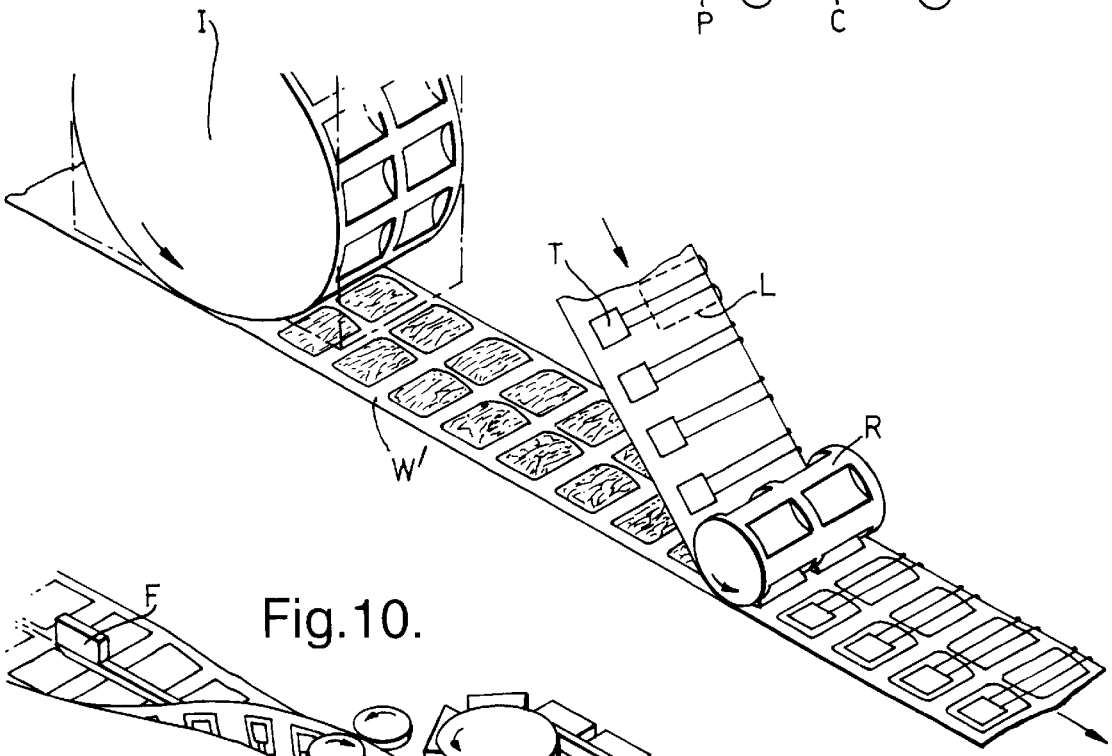
FIGS. 9 and 10 illustrate respectively, the dosing and sealing of packets which have been produced by an analogous process but which are of twin-chamber form.
Figure 10:
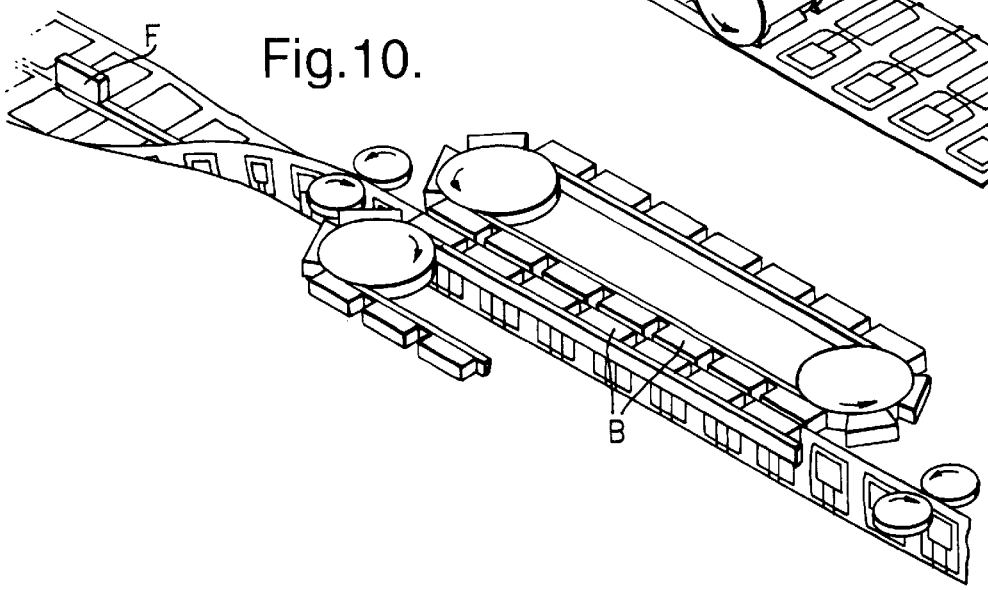

FIGS. 9 and 10 illustrate an alternative way of processing a tag-thread-web assembly produced as described with reference to FIGS. 1–6 in order to manufacture twin-compartment infusion packets. A second web W' receives pairs of doses of product from a dosing wheel I and is overlaid by the web W with its tag and thread-loop assemrblies. The two webs are sealed together at the appropriate regions by a heated roller R to leave each thread loop movable but contained in a channel surrounding three sides of one compartment of each pair. The combined webs are then doubled over by a former F (FIG. 10), the compartments sealed together by heating elements mounted on opposed endless belts B, and the individual packets are separated (not shown).

We claim:

1. A method of producing packets each comprising an envelope formed from a web and containing a flowable material and each provided with a thread attached to a tag for contracting the packet comprising the steps of:

(i) forming thread loops, each loop having a pair of end portions and an intermediate portion between said end portions, and attaching the end portions of each loop to a respective tag, (ii) placing one face of the web against the intermediate portions of the thread loops while maintaining the web spaced from the tags and loop end portions, and releasably attaching the web to the intermediate portions of the thread loops, (iii) bringing the tags with said loop end portions of the thread loops over a face of the web opposite said one face and attaching them thereto, and (iv) doubling over the web to form a flattened tube, said intermediate portions of said loops being thereby located between opposed walls thereof and said opposite face of the web carrying said tags and end portions of said loops forming an exterior face of said tube.

2. A method according to claim 1 wherein each loop intermediate portion is drawn out to elongate form and is then given a shape in which it is held between said web walls, and is held under tension while being shaped.

3. A method according to claim 1 wherein doses of the flowable material are contained between said opposed walls, each said loop intermediate portion having a pair of mutually spaced lengths and each dose being placed between said spaced lengths, sealing the walls together to hold said doses and loop portions between them and to enclose the doses in respective sealed compartments, and severing the webs to form individual packets each having a dose of the flowable material and a tag and thread-loop assembly.

4. A method according to claim 3 wherein each loop intermediate portion is drawn out to elongate form and is then given a shape in which it is held between said web walls, and is held under tension while being shaped.

5. A method according to claim 3 wherein said opposed walls are sealed together to form channels for said intermediate portions of the thread loops that are discrete from said compartments.

6. A method according to claim 5 wherein each loop intermediate portion is drawn out to elongate form and is then given a shape in which it is held between said web walls, and is held under tension while being shaped.

7. A method according to claim 5 wherein each said compartment has a peripheral region and said channels extend around at least a greater part of said peripheral region.

8. A method according to claim 7 wherein each loop intermediate portion is drawn out to elongate form and is then given a shape in which it is held between said web walls, and is held under tension while being shaped.

9. A method of manufacturing packets each comprising an envelope of web material and containing a flowable material, and each provided with a length of thread for contracting the packet, comprising the steps of:

(i) forming thread loops, each loop having a pair of end portions and an intermediate portion between said end portions, and attaching the end portions of each loop to a respective tag, (ii) placing one face of a first envelope web against intermediate portions of thread loops while maintaining the web spaced from the tags and temporarily attaching the web to the portions of the thread loops placed against it, (iii) bringing the tags with said loop end portions of the thread loops over a face of the web opposite said one face and attaching them temporarily thereto, (iv) locating said first envelope web against a second envelope web carrying doses of the flowable material to enclose said doses between opposed walls of said first and second webs, said thread intermediate portions being thereby disposed between the first and second webs, said opposite face of the web carrying said tags forming an exterior face of the first and second webs, and (v) joining said opposed walls of the two webs together to form sealed compartments holding the doses of flowable material and to retain said thread intermediate portions between the two webs.

10. A method according to claim 9 wherein each loop intermediate portion is drawn out to elongate form and is then given a shape in which it is held between said web walls, and is held under tension while being shaped.

11. A method according to claim 9 wherein said opposed walls are sealed together to form channels for said intermediate portions of the thread loops that are discrete from said compartments.

12. A method according to claim 11 wherein each said compartment has a peripheral region and said channels extend around at least a greater part of said peripheral region.

* * * * *